United States Patent [19]

Shea et al.

[11] Patent Number: 4,788,649

[45] Date of Patent: Nov. 29, 1988

[54] PORTABLE VOCALIZING DEVICE

[75] Inventors: F. William Shea, Bloomfield Hills; James P. Shea, Rochester Hills; Patrick Lademan, Troy, all of Mich.

[73] Assignee: Shea Products, Inc., Auburn Heights, Mich.

[21] Appl. No.: 693,117

[22] Filed: Jan. 22, 1985

[51] Int. Cl.[4] ..... G10L 5/00

[52] U.S. Cl. ..... 364/513.5

[58] Field of Search ..... 381/51-53; 364/513.5

[56] References Cited

U.S. PATENT DOCUMENTS

| | | | |
|---|---|---|---|
| 4,215,240 | 7/1980 | Ostrowski | 381/51 |
| 4,278,838 | 7/1981 | Antonov | 381/52 |
| 4,624,012 | 11/1986 | Lin | 381/52 |
| 4,653,100 | 3/1987 | Barnett | 381/52 |

*Primary Examiner*—Emanuel S. Kemeny

*Attorney, Agent, or Firm*—Gifford, Groh, VanOphem, Sheridan, Sprinkle and Dolgorukov

[57] ABSTRACT

A portable speech vocalizer in which a user can select phonemes and phoneme combinations for display and sounding. Switches on keyboard or joystick allow selection of sounds in two different scanning modes, as well as selection of volume and inflection of sounds, and selection of duration or speed of sounds.

12 Claims, 7 Drawing Sheets

PORTABLE VOCALIZING DEVICE

BACKGROUND OF THE INVENTION

I. Field of the Present Invention

The present invention relates generally to data processing apparatus for electronically generating a simulated voice, and more particularly to such apparatus adapted to accommodate a variety of input devices and programmable functions.

II. Description of the Prior Art

The inability to speak or the sudden loss of speaking ability substantially impairs the ability of the afflicted individual to communicate needs and desires. The problem is especially frustrating for individuals who had previously been able to freely express themselves vocally. Although there have been previously known devices for electronically synthesizing vocal expressions, the difficulty of operating the previously known vocalizing devices substantially limits the class of individuals who can operate the device, and the limited output capability can substantially restrict the users ability to communicate fully and effectively.

For example, some previously known vocalizing devices employ a keyboard having a limited number of function buttons which are actuated to identify and select numerical codes representing particular phonemes. However, it is often difficult to familiarize the user with the phonemes represented by each numerical designation, and it can be extremely difficult and time consuming to select the desired numerical codes representing a conversational output desired. Moreover, use of such devices is restricted to those persons having the physical dexterity to accurately engage the keyboard buttons individually.

In order to overcome the above mentioned disadvantages, it has often been known to provide a scanning input whereby the numerical display is automatically rotated in sequence so that a sensor operable by with a single body movement can be used to stop the displayed and desired number. While such a device requires minimal controlled body movement to operate the apparatus, the formation of dialogues and sentences can be extremely time consuming especially in view of the difficulty of identifying numerical codes rather than familiar letter or word soundings. Moreover, although it has been known to provide different levels of operation for each key on a keyboard, whereby the same key can be used for identifying one of a plurality of words, the output of each actuation of a key provides a single vocalized word output which cannot be indefinitely sustained to sound out a word by blending individual phonemes. Moreover, previously known vocalizing devices typically operate at a single tone level and in one particular voice. As a result, varying inflections cannot be provided to the vocalized output for a more personal expression, and the previously known vocalizing devices are unable to simulate the singing of a song in a manner selected by the operator.

SUMMARY OF THE PRESENT INVENTION

The present invention overcomes the above-mentioned disadvantages by providing a portable vocalizing device adapted to accommodate a plurality of input devices for selecting functions and individual phonemes and phoneme combinations. Moreover, the device includes a program for indefinitely sustaining phonemes selected by an operator so that sounds can be blended in the same manner as if spoken. Moreover, the operator can select one of a plurality of voice intonantion levels for audibly simulating spoken words at different inflections, and each voice level can be divided into a plurality of inflections so that both the pitch and frequency of the vocalized phonemes can be varied to simulate a singing output.

The vocalizing device of the present invention generally comprises a self contained power supply, microprocessor including software and data eproms for programming as well as random access memory for the storage of permanent phonemes and phoneme combinations as well as operator prepared phonemes and phoneme combinations. In addition, a keyboard face includes a plurality of keys or data identifiers arranged substantially in correspondence with the arrangement of the keys on a typewriter keyboard so as to increase familiarity with physical operation of the vocalizing device. The keyboard is preferably provided with touch sensitive switches at each data identifier so that data can be selected for access from the microprocessor. In addition, a scanner means for cyclicly or randomly accessing the data identifiers on the keyboard face is adapted to be responsive to a plurality of input switch devices.

In the preferred embodiment, the scanner means is adapted to receive input controls from a single key or single pole input, a five terminal switch input and a light sensitive detector commonly known as a light pen. Either one of these input devices will permit the operator to select desired data identifiers for introduction to the microprocessor so that related phonemes can be transmitted to synthetic vocalizing means provided in the housing of the vocalizing device. Moreover, the phonemes or phoneme combination withdrawn from memory and delivered to the voice synthesizer can be generated at one of four voice levels, level one being tthe lowest voice and level four being the highest. In addition, one of eight levels of inflection can be chosen with each voice, level number zero being the lowest intonation and level number seven being the highest intonation. The preferred embodiment also includes a separate power source for maintaining programmed information stored in a random access memory.

As a result, it can be seen that the present invention provides the operator substantially more latitude in personalizing synthetically vocalized messages than previously known vocalizing devices. Moreover, the vocalizing device can be operated with a plurality of inputs, and does not require a substantial amount of dexterity on the part of the operator to complete a vocal communication desired by the operator. Furthermore, the blending feature makes the device particularly useful as a teaching tool, especially since the sounding out of words can be accomplished at any pace which the operator requires. In addition, the device has a substantial capacity for additional programming by the user so that prolonged and personally designed communications can be stored and repeated by the vocalizing device as desired by the operator.

BRIEF DESCRIPTION OF THE DRAWING

The present invention will be more clearly understood by reference to the following detailed description of a preferred embodiment when read in conjunction with the accompanying drawing in which like reference characters refer to like parts throughout the views and in which.

DETAILED DESCRIPTION OF A PREFERRED EMBODIMENT OF THE PRESENT INVENTION

Figure 1:
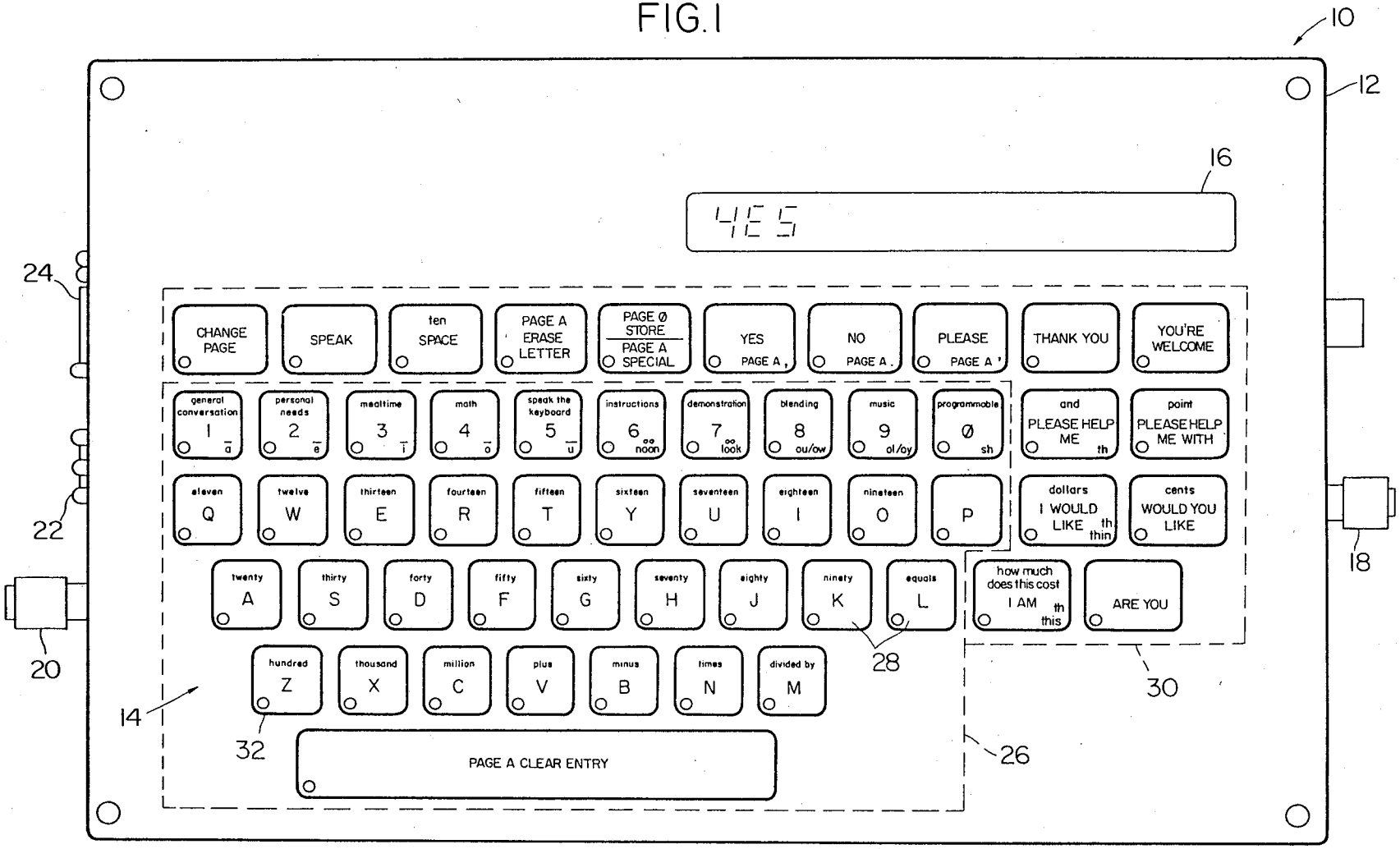
FIG. 1 is a top plan view of vocalizing apparatus according to the present invention.

Referring first to FIG. 1, vocalizing apparatus 10 according to the present invention is thereshown comprising housing 12 including keyboard face 14. In addition, the face of the housing includes a liquid crystal display 16. An on/off-volume switch 18 extends outwardly from the housing so as to be accessible by an operator. The switch connects the power supply circuit 52 (FIG. 2) to the electrically powered components of the vocalizer, and includes a potentiometer for controlling the volume of the audible output from the vocalizing device 10. A scanning rate potentiometer control 20 also extends outwardly from the housing 12 so as to be accessible to the operator. The external connector 22 is adapted to couple a battery charger 56 (FIG. 2) for the battery 54 (FIG. 2) enclosed within the housing 12. An external, multiterminal switch connector in the form of a receptacle 24 provides access to a plurality of input switch devices as will be defined in greater detail hereinafter.

The keyboard face 14 includes a first set 26 of data identifiers 28. The data identifiers 28 of the first set 26 substantially conform with the arrangement of keys on a conventional typewriter keyboard. A second set 30 of data identifiers 28 peripherally surround the first set 26, providing ready access with respect to the other data identifiers 28. Preferably, each data identifier 28 defines the location of a touch sensitive switch whose engagement provides signals to the microprocessor within the housing 12 to provide access to stored phonemes, phoneme combinations and programmed operating instructions. Each data identifier 28 also includes visible illumination means such as light emitting diodes (LEDs) 32 whose function will be discussed in greater detail hereinafter.

For the sake of clarity, a summary of the operation of a keyboard having key switches is disclosed, although it is to be understood that the scanning means of the present invention is used in place of the keyboard switches and keyboard decoder in the preferred embodiment of the present invention. It will be understood that the microprocessor is programmed as referred to in FIG. 2, and reference to the following Table 1 and FIG. 1 will provide sufficient disclosure of the general operation of microprocessor for the purposes of understanding the present invention.

The vocalizing device of the present invention operates in several categories, termed pages, which change the data related to each data identifier. As shown in Table 1, wherein the data identifiers in set 30 are referred to as special function (SF) keys. While many of the data entries assigned to each data identifier in the second set 30 remain the same regardless of the page selected by the operator, the data related to each data identifier 28 in the first set 26 are related to a different data signal on each page.

When the vocalizing device is turned on, page 1 is automatically selected although the page can be readily changed by pressing the Change Page switch under the data identifier 28 at the left end of set 30 (SF) 1 and the numerical data identifier 28 in set 26 corresponding to the page desired. The output for each data identifier 28 when operating in Pages 1-5 is identified in Table 1. The vocalized output on the alphabetic keys on Page 6 is summarized in Table 1 to communicate the types of instructions which are spoken when the vocalizing device is operated on Page 6. Table 1A includes a summary of the vocalized conversation and musical output produced when the vocalizing device is operated on Page 7. The vocalized outputs referred to in Table 1A at Page 8 indicate the phoneme sound which can be generated and sustained in a manner to blend sounds in a manner desired by the operator as will be discussed in greater detail hereinafter. The vocalized outputs at Page 9 are indicated by the musical notes which can be generated on the lettered data identifiers in set 26.

As is also indicated in Table 1A, Page A and Page 0 permit phoneme combinations to be assigned to data identifiers 28 as desired by the operator. While Page A permits the operator to create desired expressions temporarily, Page 0 includes means for storing the created phoneme combinations as will be described in greater detail hereinafter.

Figure 2:
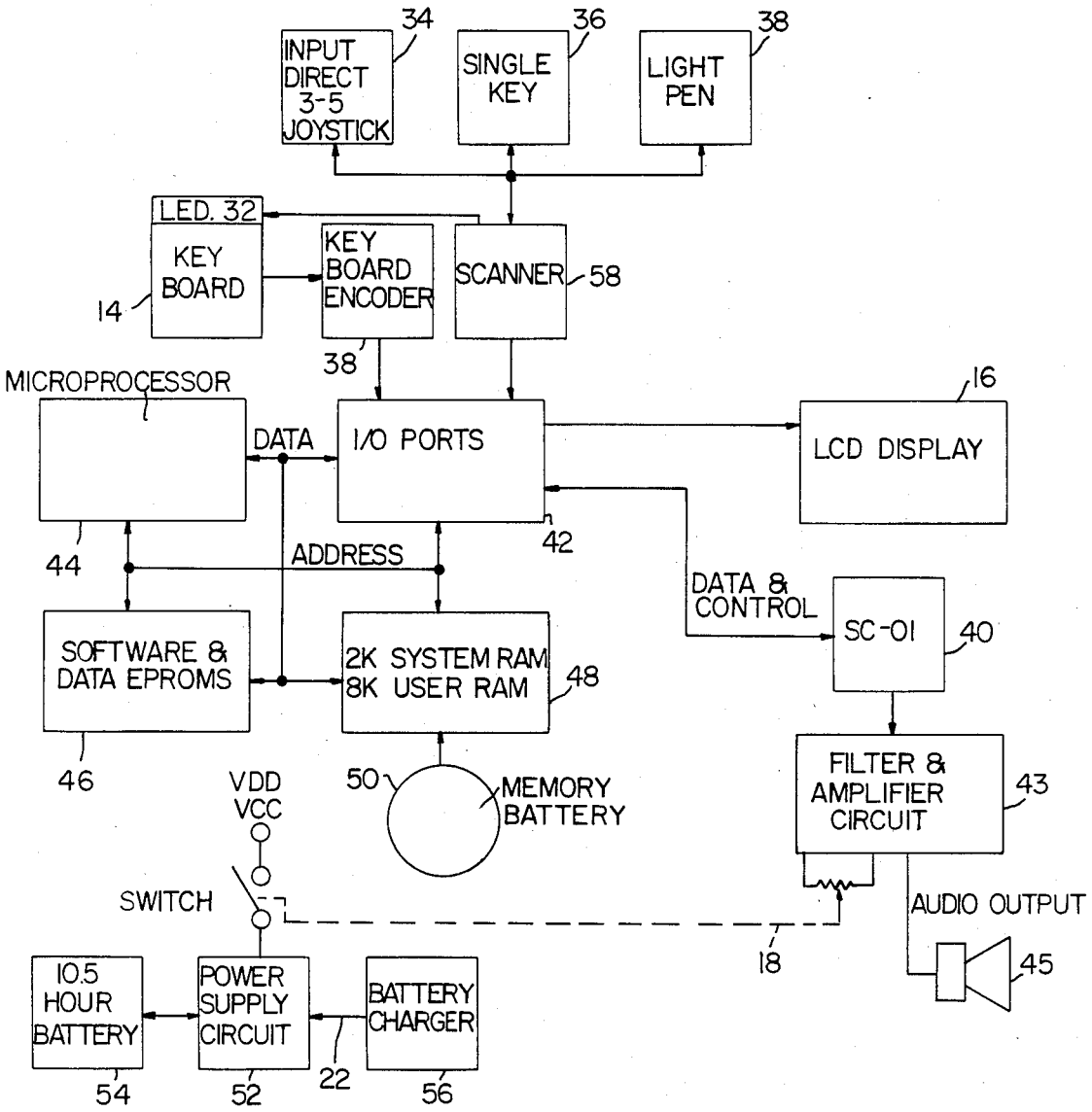
FIG. 2 is a flow diagram illustrating particular components of vocalizing apparatus shown in FIG. 1.

Referring now to FIG. 2, the keyboard face 14 provides entry to the keyboard decoder so that actuation of the data identifier switch so that selected sound data can be recalled from storage and delivered to voice synthesizer means 40. Of course, I/O ports 42 provide delivery of data to the outputs such as the voice synthesizer 40 and LCD display 16 and from inputs such as the keyboard face 14 having switches and additional input means to be described in greater detail hereinafter. The I/O ports 42 also provide means for the microprocessor 44 to operate with data and instructions from software and data EPROMS 46 and the random access memory (RAM) 48. A particularly advantageous feature of the present inventon is that the RAM memory includes a memory battery circuit means 50 so that data programmable by the operator can be stored indefinitely.

A power supply circuit 52 provides a regulated power signal to the electronic components of the vocalizing device 10 in a well known manner. Preferably, the power supply 52 derives power from a source such as a battery 54. In addition, the battery is the rechargeable type, and a battery charger 56 can be coupled to the five plug charger connector 22 referred to previously in FIG. 1.

While the keyboard 14 provided with switches is a useful means for providing vocalized output as previously discussed, the present invention includes a scanner means 58 which, in combination with one of a plurality of substantially different input switch devices 34, 36 and 38, permits the selection of data in the same manner that keyboard face 14 can be employed without the need for precise manipulation of keyboard switches. As a result, scanner means 58 and the input devices 34, 36 and 38 provide a substantially easier means for generating synthesized speech than previously known keyboard actuated vocalizing devices without sacrificing the ease of identifying familiar keyboard positions as will be described in greater detail hereinafter.

Figures 1, 3:
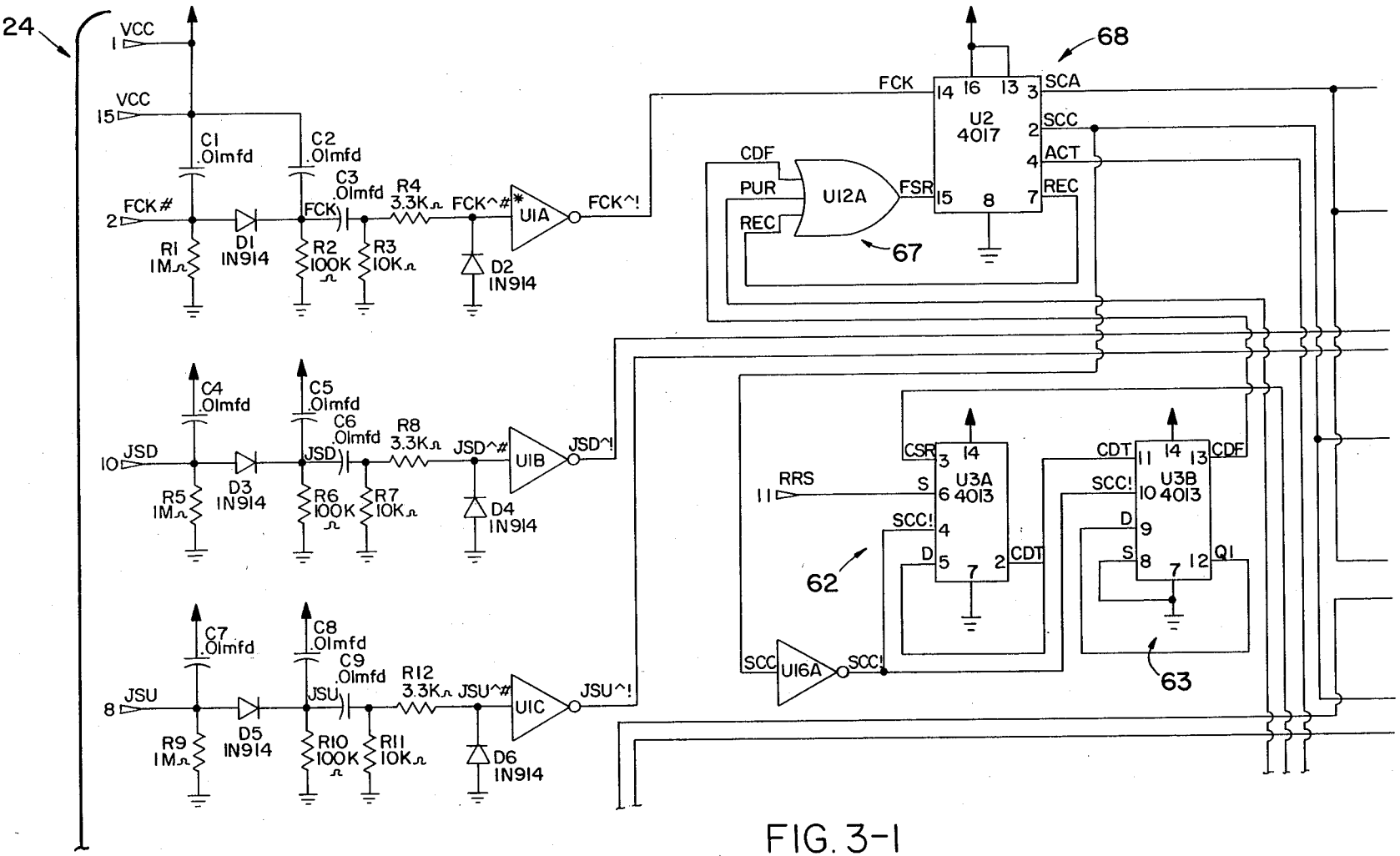
FIGS. 3 and 3A form a schematic diagram of scanning portion of the apparatus shown in FIG. 2.
Figures 2, 3:
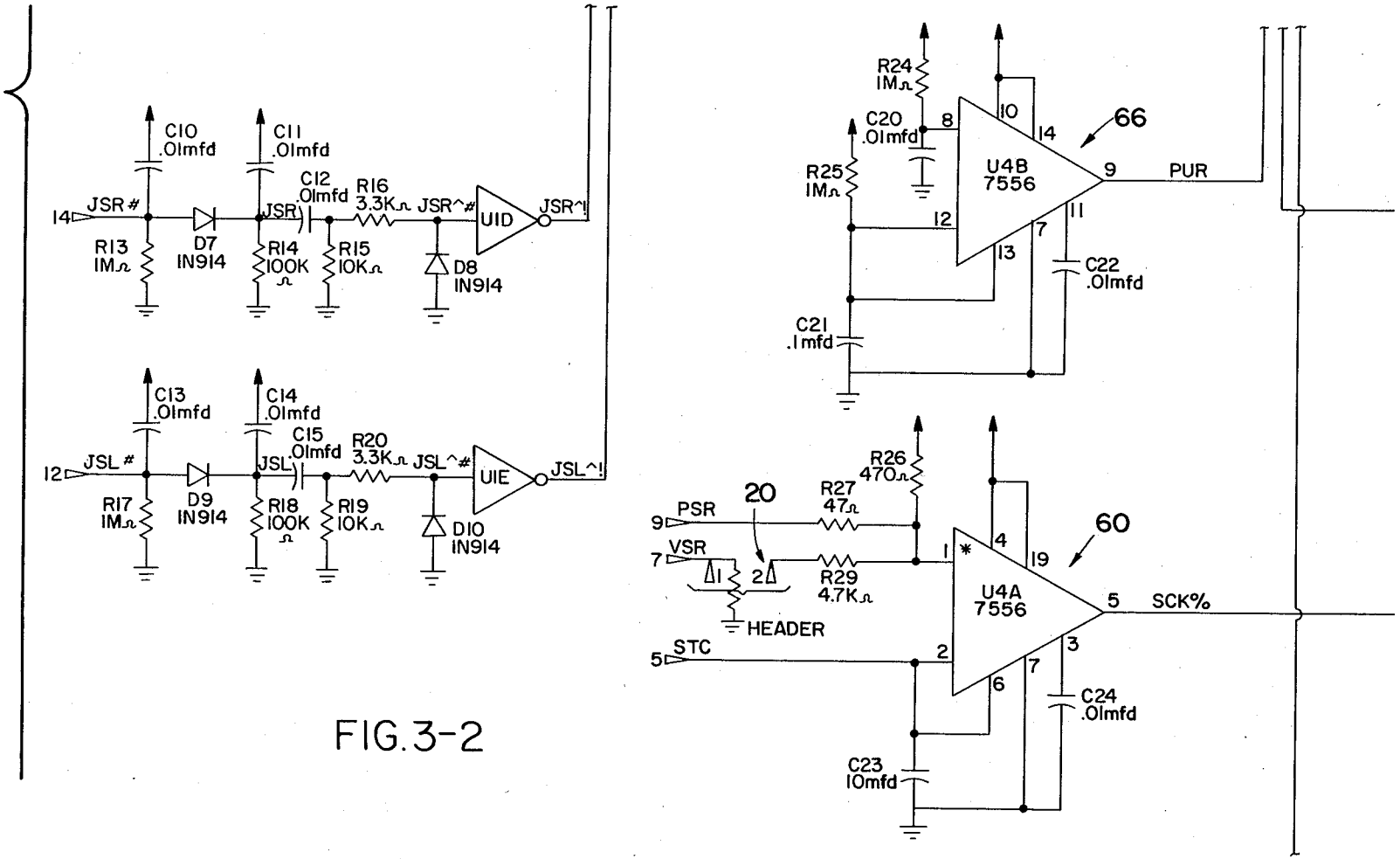
Figure 3:
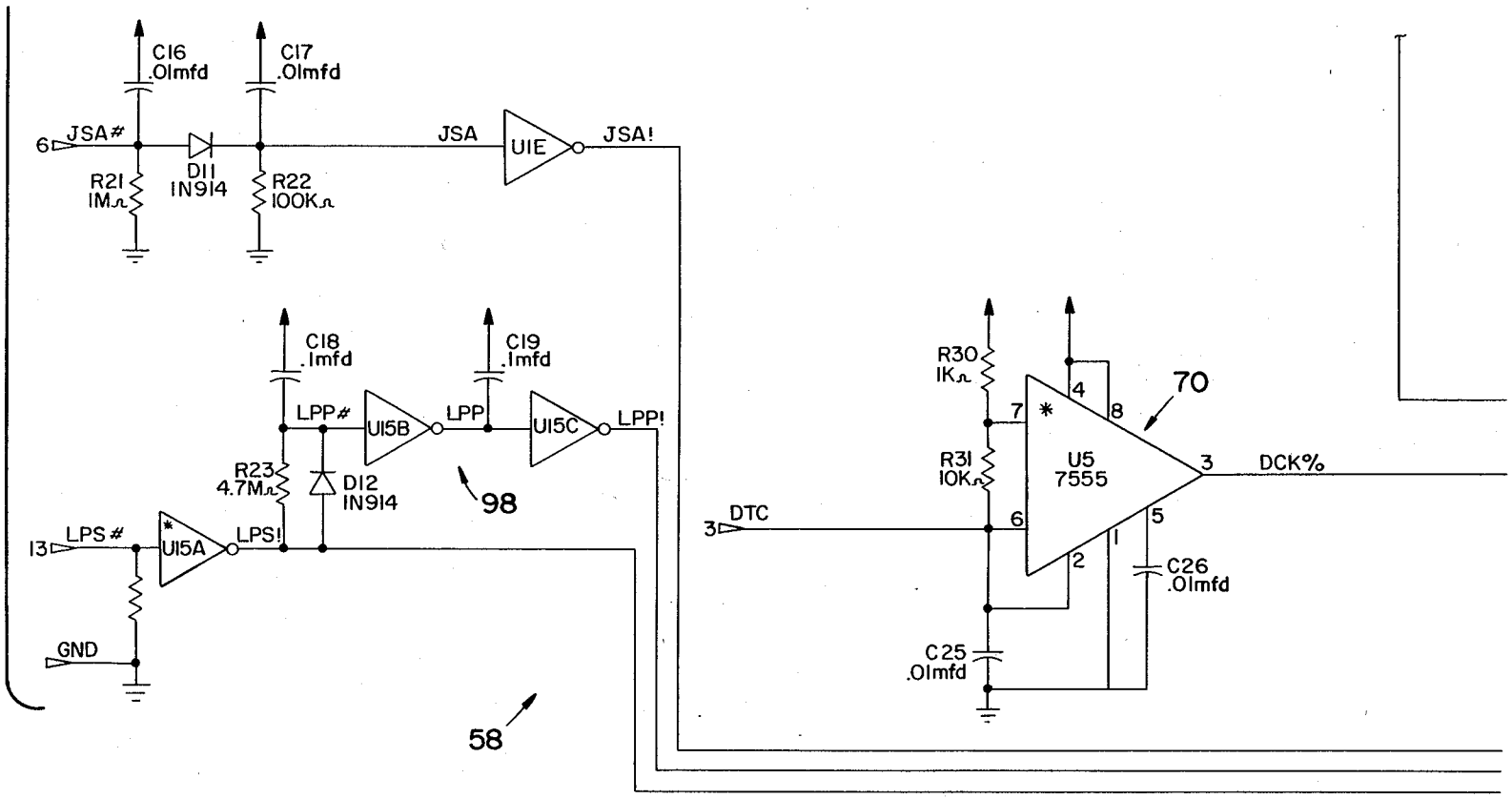
Figures 1, 3A:
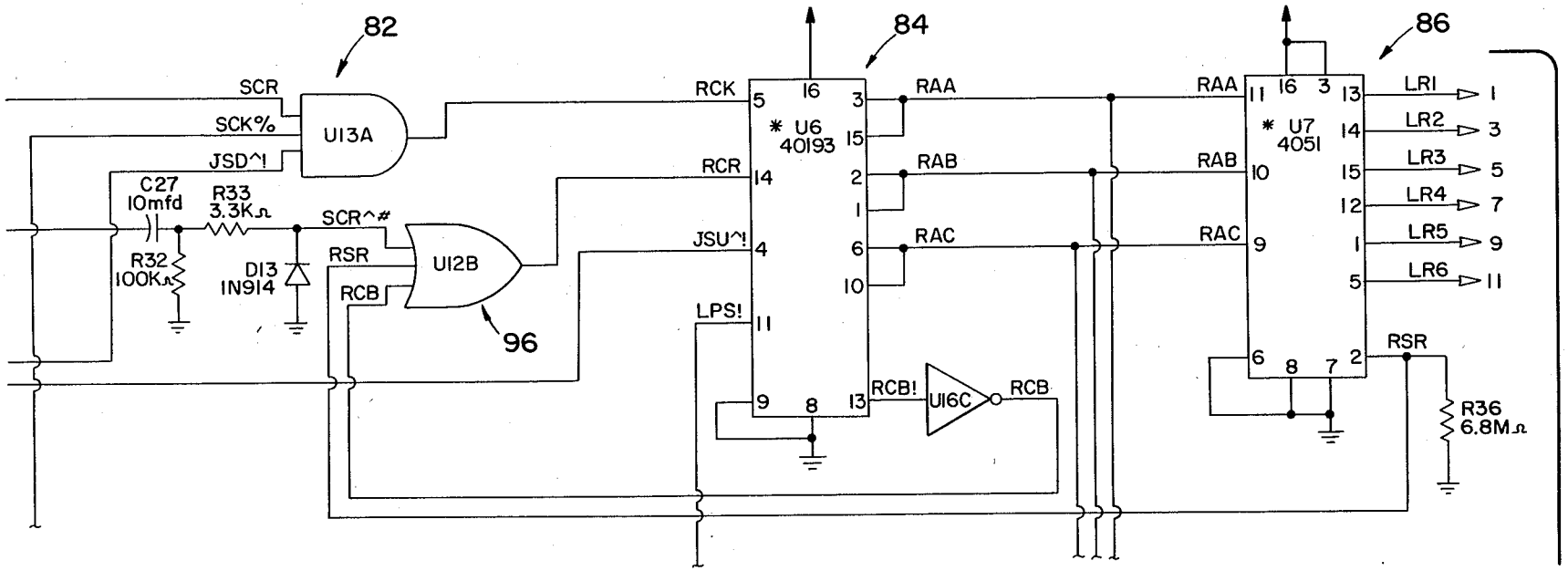
Figures 2, 3A:
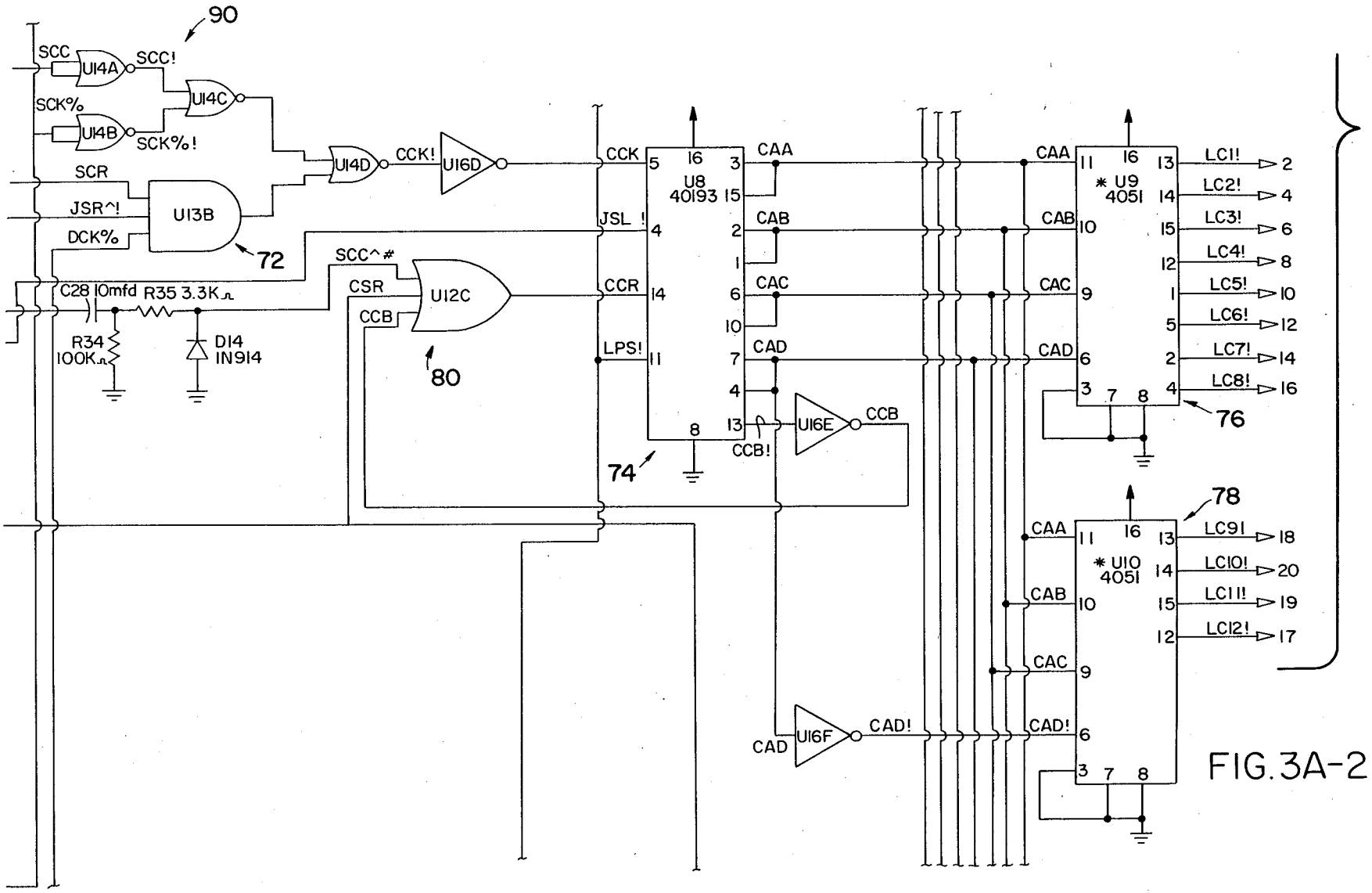
Figures 3, 3A:
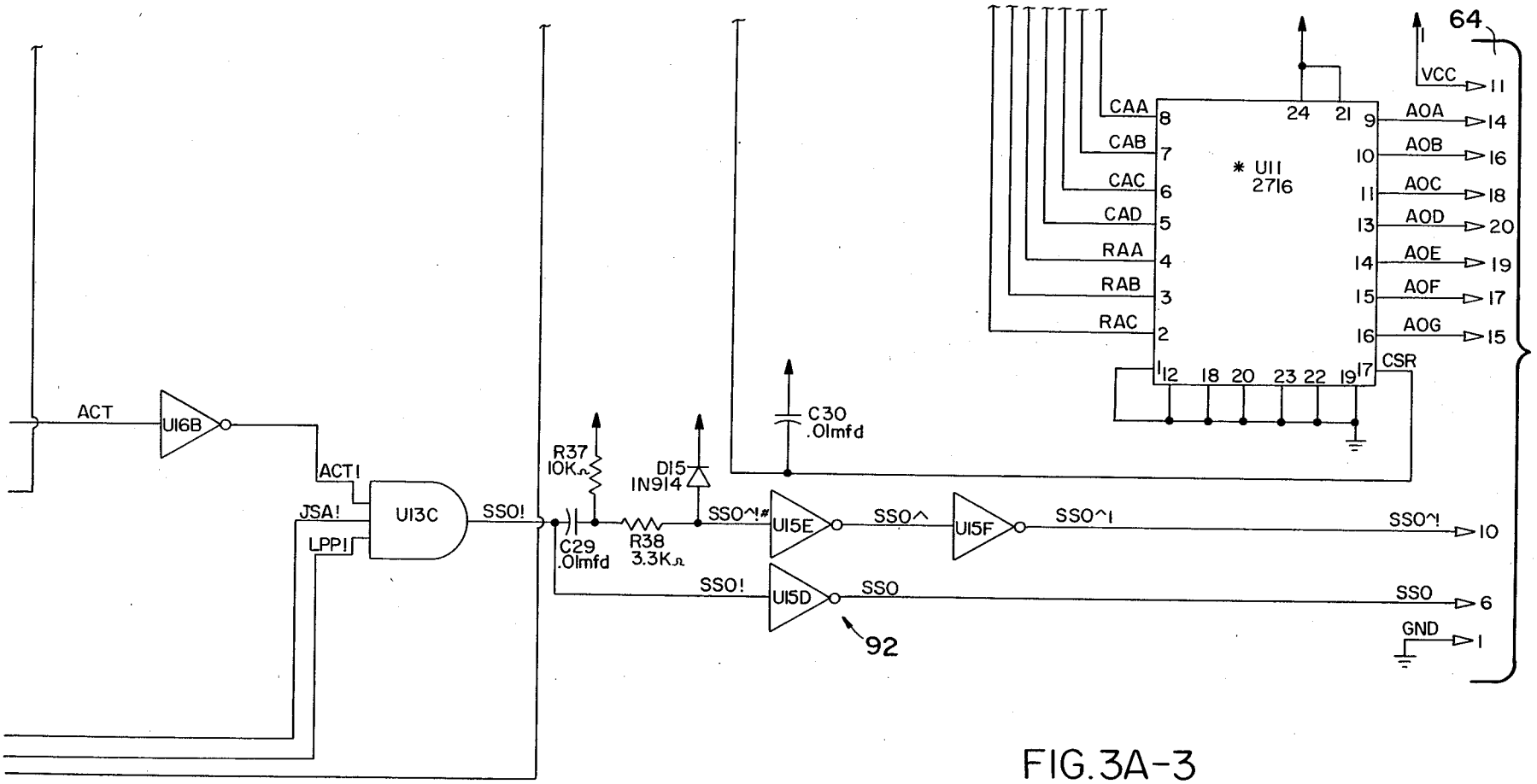

As is best shown in FIG. 3, when single key input 36 in the form of a normally open, single pole switch is desired to accommodate an operator having minimal motor skills, the contact terminals of the switch 36 are wired across the terminals FCK# and VCC. Scan timing capacitor terminal STC of the scanning clock 60 is secured to the variable scan rate terminal VSR. As a result, the scan clock oscillation frequency can be adjusted by the potentiometer control 20 (see also FIG. 1) secured across the terminals of the two pin header diagrammatically indicated in FIG. 3. The scanner 58 is operable in two modes when the single pole switch 36 is being used. In the first mode, terminal RRS of the row reset select circuit 62 is coupled to VCC and, as a result, the row reset select circuit is disenabled so that the horizontal rows of data identifiers 28 are repeatedly scanned until an actuation of the switch 36 is made. In the second operating mode, terminal RRS is connected to ground, whereby the row reset select circuit 62 operates in response to a signal generated at the ASCII generator ROM 64 to reset the function select circuit 64 to a row scanning function at the horizontal rows of data indicators 28 have been scanned to a complete cycle.

When the single pole switch 36 has been connected as discussed, the powerup reset circuit 66 provides a signal PUR to cause the gate 67 to reset function select circuit 68 to a row scanning function. Scan clock circuit 60 and display clock circuit 70 are actively oscillating at powerup, whereby gate 72 provides an output to the column address generator 74 oscillating at the rate of output DCK% from the display clock 70. As a result, column address generator 74 provides a binary output which is sequentially incremented at the rate DCK%, typically, a frequency of approximately of 5500 hertz in the preferred embodiment of the present invention. The LED column drivers 76 and 78 transform the binary format signal to a signal adapted to light up the LED's 32 in the first row. The binary format output is also applied to the ASCII generator ROM 64 for delivery as ASCII outputs. The ASCII generator ROM 64 provides a column scan reset signal CSR when the last LED 32 in the row has been activated whereby the gate 80 reset the column address generator 74 to column 1. The DCK% oscillating signal frequency substantially exceeds the frequency at which pulses can be detected by the eye whereby all of the LED's in the row appear to be lit.

While the LED's in the entire row appear to be illuminated, the row clock 82 provides an output oscillating at the frequency SCK% set by the potentiometer control 20 to the row address generator 84. Thus, the row address generator 84 continuously increments and provides binary format output to the LED row driver 86. The inputs to the LED row driver are also delivered to the ASCII generator ROM 64. As a result, the scanner appears to light one row of LED's at a time, as the row illuminated changes at the speed chosen by the user. When the switch 36 is wired for operation in the first mode of the scanning means 58, the scanning of the rows can continue indefinitely until the switch 36 is activated.

When the switch 36 is activated, the input circuitry 88 actuates the signal through three stages to remove switch bounce from the signal for acceptance by an inverter which buffers the signal for use throughout the scanning circuit 58. A conditioned signal FCK~! is received at the function select circuit 68 to increment the circuit to the next function which is scanning a column. Since the scan row signal SCR is then removed, row clock 82 latches the row address generator 84 at the row illuminated when the switch 36 was closed. The gate 80 thus provides a signal to the column address generator 74 which resets the column address generator 74. Signal SCC is also delivered to gate 90 to adjust the column address generator 74 for operation at the frequency selected by potentiometer control 20. If the scanning means 58 is connected for mode one operation, the scanner will stay on the row and display the LED's 32 in that row column by column indefinitely or until the switch 36 is closed to go to the next function. Conversely, if the scanning means 58 is connected for mode two operation on second mode, the sequential lighting of LED's 32 in the row will occur twice. Then the reset select circuit 63 resets the function select circuit 68 to the scan row function at terminal SCR.

When the switch 36 is closed the scan column function of the function select generator 68 is active, the function select circuit 68 increments to the next function at terminal ACT. Since the signal at terminal SCC of the function select circuit 68 has been terminated, gate 90 causes the column address generator 74 to latch, whereby the LED 32 that was lit at the time the switch 36 was closed remains illuminated. As the function select circuit 68 is now set to actuate, whereby a signal through a buffer circuit 92 is delivered to the microprocessor circuitry 44 at terminal 75, and at terminal 77 for a microboard adapted to detect the presence of prolonged activation of the switch 36. Subsequent actuation of the switch 36 provides a signal to the function select circuit 68 enabling it to recycle to the scan row function.

Figure 5:
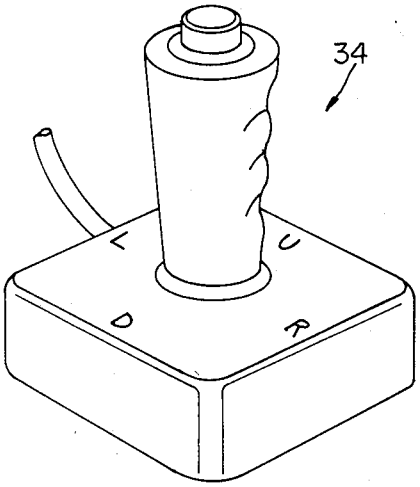
FIG. 5 is a perspective view of an input switch device shown in FIG. 2.

The scanner 58 is also adapted to receive the input of a five switch input switching device 34 and is useful for operators having the ability to control more than one movement. In the preferred embodiment, such an input switch or combination of switches can be provided by a switch housing having at least 3 and up to 5 contact terminals. A four position joystick switch with an actuating button is used in the preferred embodiment as shown in FIG. 5. As shown in FIG. 3, the scanning means 58 is connected through buffering input circuits to five switch terminals JSU#, JSD#, JSL#, JSR# and JSA#. The terminals of each toggle operated switch, each switch to be generally referred to as U, D, R, L and A in FIG. 5, are connected between terminal VCC and its respective input terminal JSU#-JSA#. Although the actuating switch A can be conveniently positioned at the end of the toggle lever, as shown it will be understood that a variety of five switch consoles such as five button switch console or a 4 position toggle with console mounted switch can be utilized in operation of the present invention.

At powerup with the switch input device 34 connected as described above, the initiating reset circuit 66 is operative to force the function select circuit 68 to be reset to the scan row function. As a result, the row address generator 84 and a common address generator 74 generate an output to the LED row driver 86 and the LED column driver 76 to maintain the LED 32 in the first row in the first column in a lighted condition. Closing of the down switch D by movement of the toggle lever causes the row address generator 84 to increment so that the output signal delivered to the LED row driver 86 causes the LED 32 in the next row but the same column to become illuminated instead of the first LED 32. When the LED 32 in the last row is illuminated, and the switch D is again activated, gate means 96 causes the LED 32 of the first row to become illuminated.

Every time the up switch U is closed, the LED 32 illuminated turns off and the LED above the previously lit LED becomes illuminated. If the LED 32 in the first row is lit, actuation of the switch U will not affect illumination of the LED 32 in the first row, and the same LED will remain lit. Actuation of the switch R at terminal JSR# turns off the lit LED 32 and turns on the LED to the immediate right of it in the same row. If the LED 32 in the last row is illuminated when the switch is closed, the last LED 32 in the row will turn off and the first LED in the row will be illuminated. Although actuation of the switch L turns off the lit LED and turns on the LED 32 to the left of the previously lit LED, the LED 32 in the first column is lit, actuation of the switch L will not change the position in which the LED is lit. When the actuating switch A is closed, the key or data identifier 28 illuminated governs the ASCII output delivered to the microprocessor in a manner similar to that described with respect to the actuating switch 36 when the function select circuit 68 is in the actuating mode.

Alternatively, it will be understood that a switch means having only 5 contact terminals of the right and down switches could be used because repeated operations can be substituted for the left and up switches.

An alternative means adapted to be used with a scanner 58 of the present invention is a light pen having a phototransistor as a light sensitive detector positioned at the end of a light pen so that it can be manipulated into a position where the detector is in registration with an LED 32 on the keyboard face 14. This input mode is especially helpful for an operator limited to head movements and can also provide an instructor with an easy method for quickly programming specific phase information into the vocalizing device's user memory 48 without the restrictions of the other input modes. The collector of the phototransistor is wired to VCC. The emitter of the phototransducer is wired to terminal LPS# on the connector 24. Terminal STC of scan clock 60 is connected to terminal PSR of the scanning clock 60. As a result, the scan clock provides a high oscillation frequency for operation of the row address generator 84 and the column address generator 74 through the gates 82 and 90, respectively, so that all of the LEDs on the keyboard face 14 will be faintly lit.

As the light pen is manipulated over the keyboard face 14, and is brought into registration with a particular key identifier 28 so that the phototransistor is aimed at the LED, the signal generated by the phototransistor is received at the row address generator 84 and column address generator 74. As a result, the LED row driver 86 and LED column drivers 76 and 78 brightly illuminate the LED at which the light pen is aimed while the remaining LED's 32 turn off. The actuating circuit 98 senses when the light pen remains aimed at the LED for a predetermined time, typically one half second, and then generates a signal to the ASCII output so that the output signals at terminals 75 and 77 are provided as in the same manner as with the other input switch devices.

Figures 1, 4:
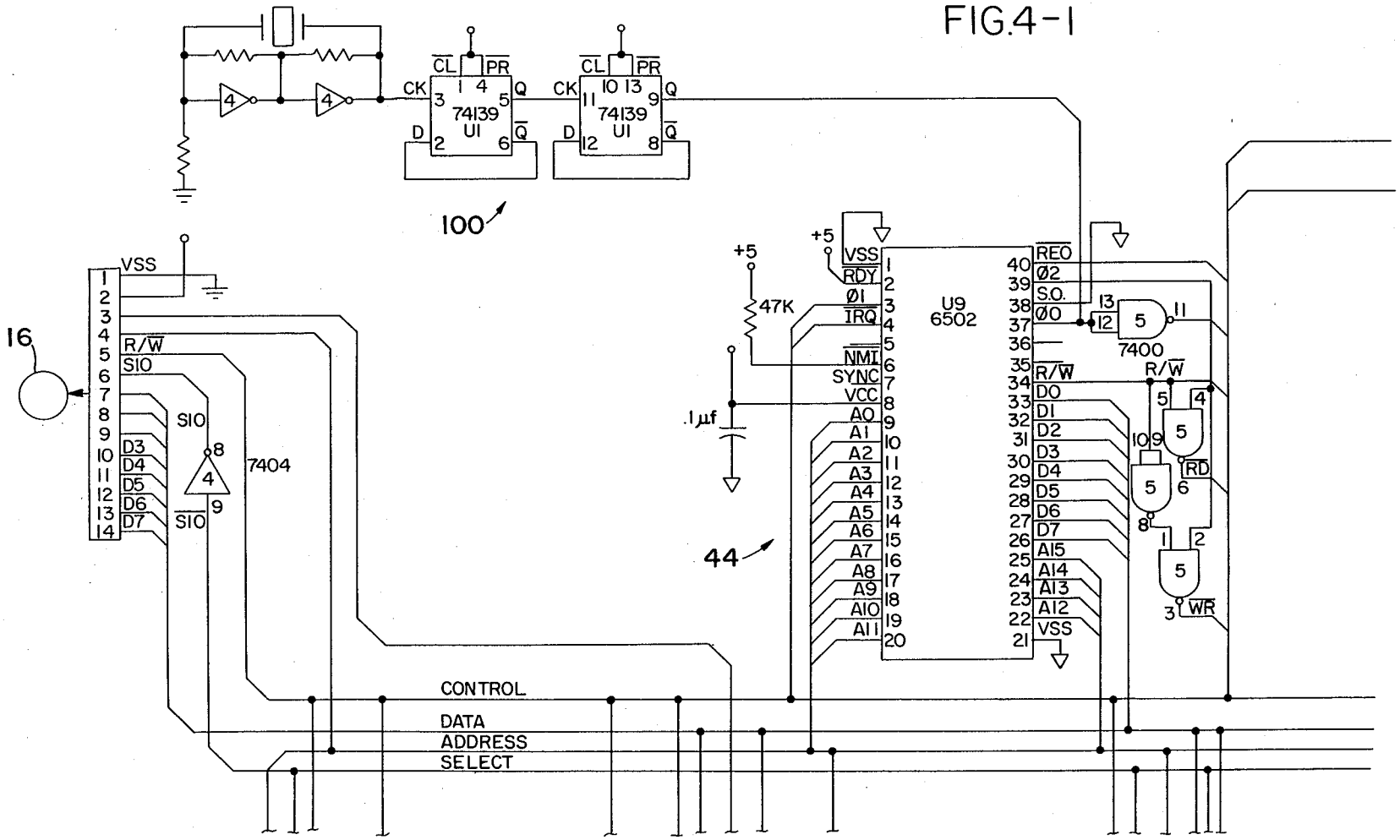
FIGS. 4 and 4A form a schematic diagram of portion of the data processor system shown in FIG. 2.
Figures 2, 4:
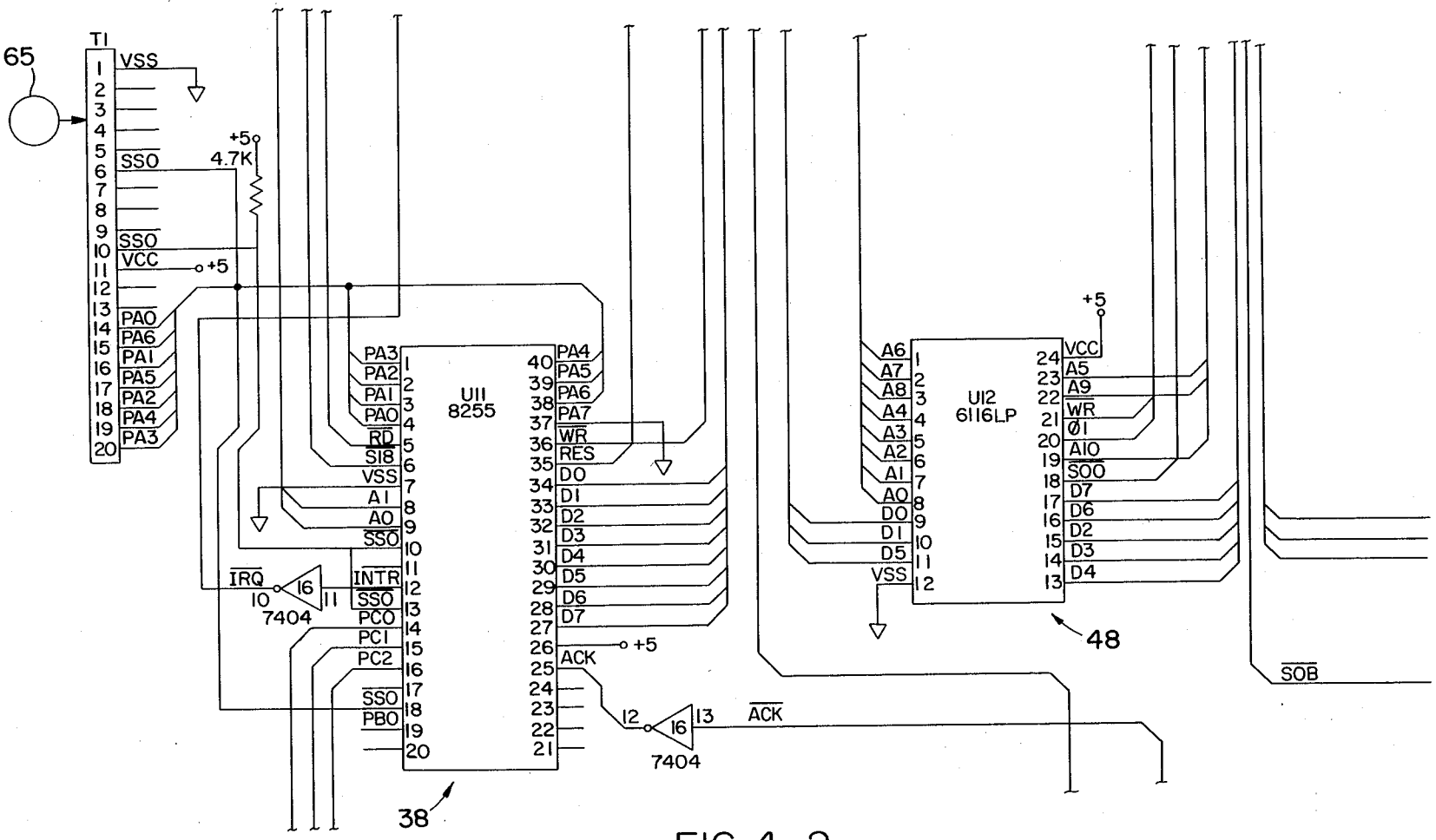
Figures 3, 4:
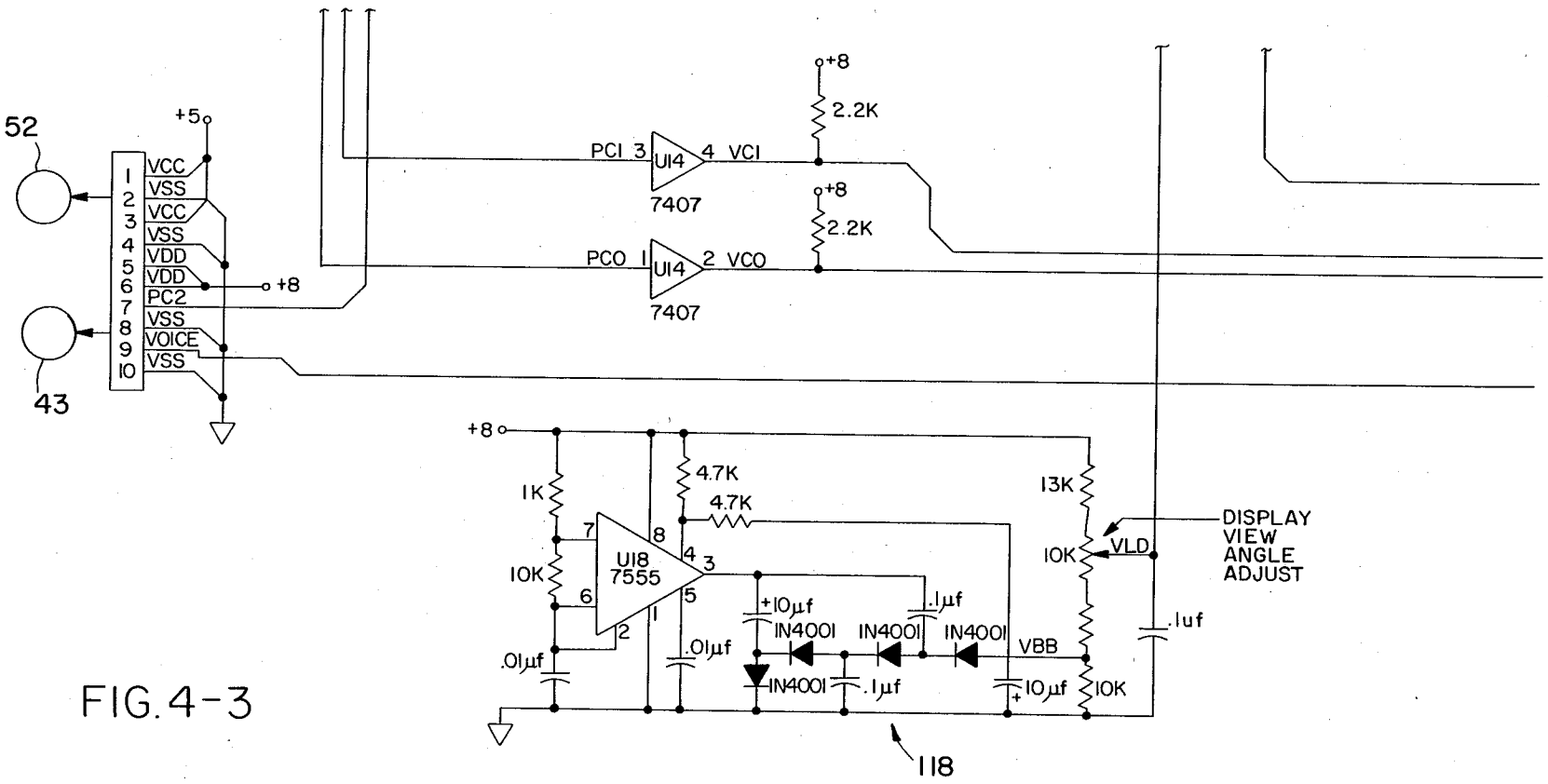
Figures 1, 4A:
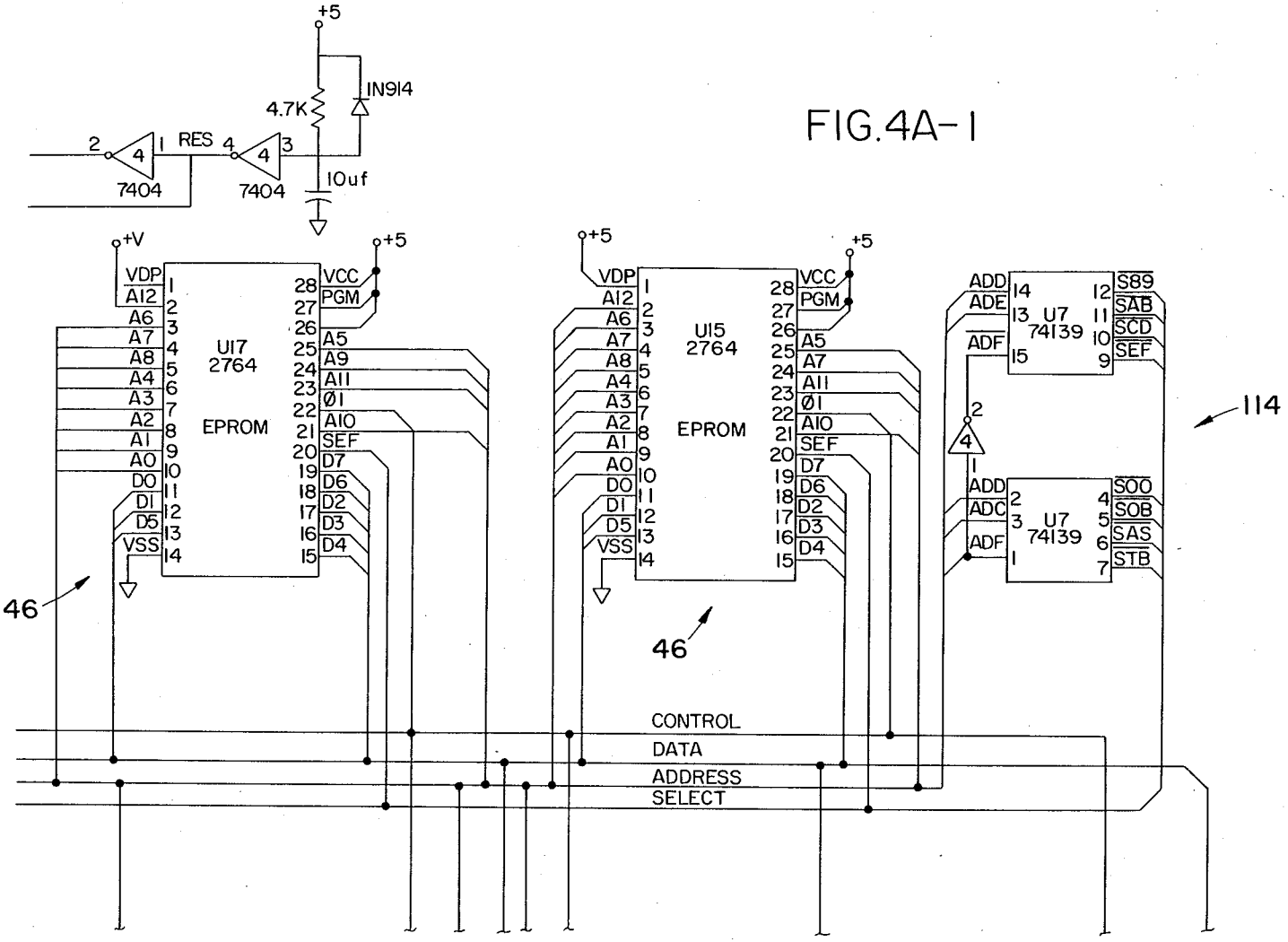
Figures 2, 4A:
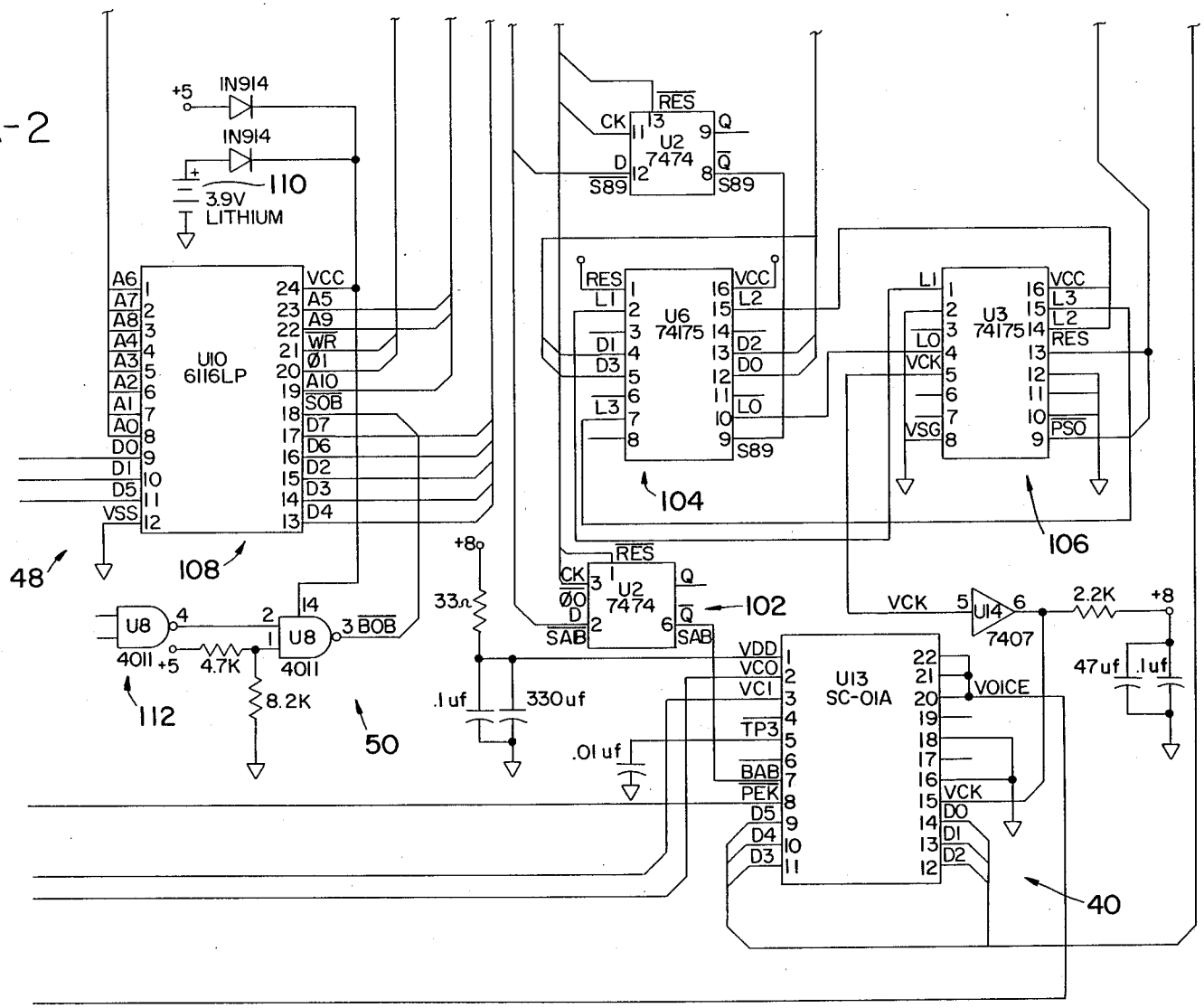

Referring now to FIG. 4, the ASCII output 65 is delivered to the microprocessor through input/output ports 42. FIG. 4 discloses details of the microprocessor 44 including an operating circuit 100, the eprom circuits 46, the random access memories 48 and the voice synthesizer 40. Moreover, it can be seen that in the preferred embodiment of the present invention, the voice synthesizer 40 receives input through a latch 102 from a voice level control 104. The particular 8255 IC utilized for the voice level control 104 provides four different levels wherein the first voice is the lowest voice and the fourth voice is the highest voice. Moreover, when a voice has been selected by selector 104, the inflection level control 106 provides seven levels of inflection for each voice. The IC 9497 of inflection control 106 combines with the voice level 104 to provide a wide range of tone control, whereby vocalizing device 10 can be programmed to sing a message.

Thus, on one of the pages 0 or A where messages can be constructed, an inflection for each phoneme or phoneme combination selected can be set by actuating the data identifier 28 on the letter V and then a number from 1–4. Next, the inflection can be set by actuating the key or data identifier 28 bearing the letter L and the data identifier bearing one of the numbers 1–7. Thus, a wide range of inflections can be employed in the vocalization simulated by the synthesizer 40 and generated components 43 and 45 shown in FIG. 2. As is also shown in FIG. 4, the chip providing user memory for the RAM 48 includes a battery back-up circuit 50 having a battery 110. In addition, the driver circuit 112 assures that the battery 110 is powering the chip 108 without interuption when the power is disconnected from the remaining components of the circuit.

As is also evident from FIG. 4, the address code circuitry 114 converts the data used for forming the vocalized sound to provide an alphabetic character display at the LCD display 16. In addition, the display view angle adjust circuit for the LCD display is shown at 118 in FIG. 4. As a result, the display of letter characters at the display 16 can be adjusted to coincide with viewing angle of an operator. Thus, the viewing angle can be set to particularly accommodate operators who may be immobile or whose movement is substantially restricted.

Figure 6:
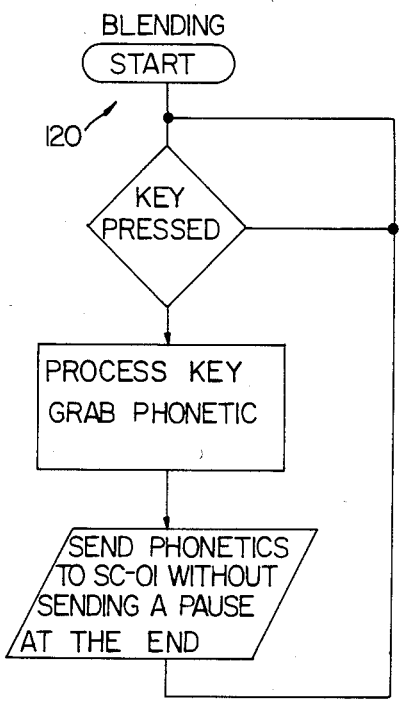
FIG. 6 is a flow diagram illustrating operation of a portion of software program diagrammatically referred to at FIG. 2.

Referring now to FIG. 6, another advantageous feature of the present invention is shown in block diagram form. A vocalizing device 10 of the present invention also includes a blending operation which is accomplished by means for sustaining a phoneme for a prolonged period, whereby operator can actually sound out words. Both hard and soft sounds can be sustained with the blending feature of the present invention. During operation of the keyboard face or other input devices when page 8 has been selected, actuation of the input switch device does not provide a stop signal which normally follows a data signal automatically in the microprocessor when other pages are being used. On page 8, the elogated space bar data identifier 28 corresponds with a stop signal so that a completely sounded word can be terminated. A print out of the program 120 is recited below for complete disclosure of the means for overriding the automatically generated stop signal when other pages are employed.

PHR-T03

```
0030
0040 ;ALPHA KEYS BLENDING:
0050 ;-------------------
```

```
D587- 2F AE      0060 PHRT08      .BY '/' $2E+$80 ;A=AH
D589- 4E 4E C3   0070             .BY 'NN' $43+$80 ;B=BH
D58C- 59 59 C3   0080             .BY 'YY' $43+$80 ;C=XH
D58F- 5E 5E C3   0090             .BY '^^' $43+$80 ;D=DH
D592- B9         0100             .BY $3B+$80          ;E=EH
D593- DD         0110             .BY $5D+$80          ;F=FH
D594- 5C C3      0120             .BY '\' $43+$80 ;G=GH
D596- DB         0130             .BY $5B+$80          ;H=HH
D597- C9         0140             .BY $49+$80          ;I=IH
D598- 5E DA      0150             .BY '^' $5A+$80 ;J=JH
D59A- 59 59 C3   0160             .BY 'YY' $43+$80 ;K=KH
D59D- 59 D8      0170             .BY 'X' $58+$80 ;L=LH
D59F- CC         0180             .BY $4C+$80          ;M=MH
D5A0- CD         0190             .BY $4D+$80          ;N=NH
D5A1- A4         0200             .BY $24+$80          ;O=OH
D5A2- 25 25 C3   0210             .BY 'ZZ' $43+$80 ;P=PH
D5A5- 59 59 AD   0220             .BY 'YY' $2D+$80 ;Q=XH
D5A8- AB         0230             .BY $2B+$80          ;R=RH
D5A9- DF         0240             .BY $5F+$80          ;S=SS
D5AA- 2A 2A C3   0250             .BY '**' $43+$80 ;T=TH
D5AD- B3         0260             .BY $33+$80          ;U=UH
D5AE- CF         0270             .BY $4F+$80          ;V=VH
D5AF- AD         0280             .BY $2D+$80          ;W=WH
D5B0- 59 59 43   0290             .BY 'YYC' $5F+$80 ;X=XX
D5B3- DF
D5B4- A2         0300             .BY $22+$80          ;Y=YH
D5B5- D2         0310             .BY $52+$80          ;Z=ZZ
                 0020             .FI 'PHR.T09'


0360  2A43-2DA3  PHR.T09
0360  2A43-2DA3  PHR.T09
```

PHR_T09

```
                 0030
                 0040 ;BLENDING NUMERICS:
                 0050 ;-----------------
                 0060
D5B6- D1         0070 PHRT09      .BY $51+$80          ;0=SH
D5B7- 46 21 AC   0080             .BY 'F!' $2C+$80 ;1=AY
D5BA- AC         0090             .BY $2C+$80          ;2=EY
D5BB- 55 40 49   0100             .BY 'U@I' $2C+$80 ;3=IGH
D5BE- AC
D5BF- 35 B7      0110             .BY '5' $37+$80 ;4=OWE
D5C1- 22 36 B7   0120             .BY '"6' $37+$80 ;5=YOU
D5C4- A8         0130             .BY $28+$80          ;6=GO (MOVE)
D5C5- D7         0140             .BY $57+$80          ;7=UH (LOOK)
D5C6- 55 23 AD   0150             .BY 'U#' $2D+$80 ;8=OW
D5C9- 35 23 49   0160             .BY '5#I' $21+$80 ;9=IO (BOY)
D5CC- A1
                 0170
                 0180
                 0190 ;BLENDING PERMANENT KEYS:
                 0200 ;-----------------------
                 0210
D5CD- 2A D0      0220             .BY '*' $50+$80 ;-=CH
D5CF- B9         0230             .BY $39+$80          ;^=TH (THINK)
D5D0- B8         0240             .BY $38+$80          ;!=THV (THE)
D5D1- 25 5B 3C   0250             .BY 'ZX()RR[B@XZL()C-KI99LU@I)'      ;@=PLZ HLP
D5D4- 29 52 52
D5D7- 5B 42 40
D5DA- 58 25 4C
D5DD- 3C 29 43
D5E0- 2D 4B 49
D5E3- 39 39 4C
D5E6- 55 40 49
D5E9- 29
D5EA- C3         0260             .BY $43+$80
D5EB- 2D 57 5E   0270             .BY '-W^^677X#H)!Y'  ;[=WOOD U LIKE
D5EE- 22 36 37
D5F1- 37 5B 23
D5F4- 48 29 21
D5F7- 59
D5F8- C3         0280             .BY $43+$80
D5F9- 55 31 2B   0290             .BY 'U1++"6777'      ;)=R U
D5FC- 2B 22 36
D5FF- 37 37 37
D602- C3         0300             .BY $43+$80
D603- 22 3B 40   0310             .BY '"'              ;;=YES
D606- 5F 5F
D608- C3         0320             .BY $43+$80
D609- 4D 35 37   0330             .BY 'M577'           ;:=NO
D60C- 37
D60D- C3         0340             .BY $43+$80
D60E- 39 2F 40   0350             .BY '9/@IY*677'      ;,=THANX
```

```
D611- 54 59 22
D614- 36 37 37
D617- C3          0360            .BY $43+$80
D618- 22 35 36    0370            .BY '"56+-90XY2#LL'  ;.=U R WELCUM
D61B- 2B 2D 42
D61E- 40 58 59
D621- 32 23 4C
D624- 4C
D625- C3          0380            .BY $43+$90
D626- 25 5B 3C    0390            .BY 'ZX()RR'         ;/=PLEEZ
D629- 29 52 52
D62C- C3          0400            .BY $43+$50
D62D- C3          0410            .BY $43+$80          ; =PAUSE
                  0420
                  0430
                  0600            .FI "ETP.TRA"


0572  2A43-2FB5  ETP.TRA
```

SOS_SPK

```
                  0230
                  0240 ;BUFFER SPEAK:
                  0250 ;-------------
                  0260
F63A- A0 01       0270 BUFSPK     LDY #BUFIDX          ;TERMINATE STRING
F63C- 88          0280            DEY
F63D- A9 9D       0290            LDA #$8+$80          ;TERMINATOR
F63F- 9D 00 02    0300            STA INPBUF,X
F642- A9 00       0310            LDA #L.INPBUF        ;SET STRING POINTERS
F644- A0 02       0320            LDY #H.INPBUF
F646- 85 28       0330            STA *STRLSB
F648- 84 21       0340            STY *STRMSB
                  0350
                  0360
                  0370 ;SPEAK ENGLISH TEXT:
                  0380 ;-------------------
                  0390
                  0400            ;STRLSB, STRMSB POINT TO THE
                  0410            ;STRING THAT IS TO BE SPOKEN
                  0420
F64A- A9 00       0430 SPKTXT     LDA #0               ;SET TEXT MODE
F64C- 2C          0440            .BY $2C              ;SKIP NEXT INSTRUCTION
                  0450
                  0460
                  0470 ;SPEAK PHRASE:
                  0480 ;-------------
                  0490
                  0500            ;STRLSB, STRMSB POINT TO THE
                  0510            ;STRING THAT IS TO BE SPOKEN
                  0520
F64F- A9 80       0530 SPKPHR     LDA #%10000000       ;SET PHONETIC MODE
F651- 85 07       0540            STA *PHMFLG
F653- A5 12       0550            LDA *CLKVAR
F655- A4 14       0560            LDY *PTCVAR
F657- 85 13       0570            STA *CLKINV
F659- 8D 00 BE    0580            STA PVOCLK
F65C- 8C 82 16    0590            STY PPIPTC
F65F- A0 00       0600            LDY #0
F661- 84 03       0610            STY *PNSFLG          ;CLEAR PLAY NOTE STRING
F663- B1 28       0620 PNMTOT     LDA (STRLSB),Y       ;GET BYTE FROM STRING
F665- 20 7A F7    0630            JSR CTLBYE
F668- 90 09       0640            BCC INCPID
F66A- 20 7A F8    0650            JSR STRINT
F66D- 90 04       0660            BCC INCPID
F66F- 8D 03 A4    0670            STA PVSTRA           ;PHONEME LATCH
F672- 00          0680            BRK
F673- B1 28       0690 INCPID     LDA (STRLSB),Y       ;TERMINATOR CHECK
F675- 30 07       0700            BMI ENDPHR
F677- C8          0710            INY                  ;INCREMENT PHONEME INDEX
F678- 10 E5       0720            BPL PNMTOT
F67A- A5 28       0730 ENDPHR     LDA *STRLSB          ;END OF PHRASE
F67C- 09 F0       0740            ORA #$F0             ;BLENDING
F67E- F0 01       0750            BEQ SPHABT           ;NO PAUSE
F680- A9 47       0760            LDA #47              ;PAU
F682- 8D 00 A0    0770            STA PVCTRA
F685- 60          0780            RTS
F686- 60          0790 SPHABT     RTS
                  0800
                  0810
                  0820            .FI "SOS.INP"


0A0B  2A47-2B1D  SOS.INP
```

SOS_INP

TABLE 1

PHRASE MAP

| | KEY | | CONVERSATION PAGE 1 | PERSONAL NEEDS PAGE 2 | MEALS PAGE 3 | MATH PAGE 4 | SPEAK KEYBOARD PAGE 5 |
|---|---|---|---|---|---|---|---|
| SF | 1 | — | PLEASE HELP ME | PLEASE HELP ME | PLEASE HELP ME | PLEASE HELP ME | PLEASE HELP ME |
| SF | 2 | ∂ | PLEASE HELP ME WITH | PLEASE HELP ME WITH | PLEASE HELP ME WITH | PLEASE HELP ME WITH | PLEASE HELP ME WITH |
| SF | 3 | | I WOULD LIKE | I WOULD LIKE | I WOULD LIKE | I WOULD LIKE | I WOULD LIKE |
| SF | 4 | [ | WOULD YOU LIKE | WOULD YOU LIKE | WOULD YOU LIKE | WOULD YOU LIKE | WOULD YOU LIKE |
| SF | 5 | (LF) | CHANGE PAGE | CHANGE PAGE | CHANGE PAGE | CHANGE PAGE | CHANGE PAGE |
| SF | 6 | | I AM | I AM | I AM | I AM | I AM |
| SF | 7 | ] | ARE YOU | ARE YOU | ARE YOU | ARE YOU | ARE YOU |
| SF | 8 | / | PLEASE | PLEASE | PLEASE | PLEASE | PLEASE |
| SF | 9 | , | THANK YOU | THANK YOU | THANK YOU | THANK YOU | THANK YOU |
| SF | 10 | . | YOU'RE WELCOME | YOU'RE WELCOME | YOU'RE WELCOME | YOU'RE WELCOME | YOU'RE WELCOME |
| SF | 11 | ; | YES | YES | YES | YES | YES |
| SF | 12 | : | NO | NO | NO | NO | NO |
| SF | 13 | (BS) | | | | DOLLARS | |
| SF | 14 | (DEL) | | | | CENTS | |
| SF | 15 | (RET) | (SPEAK) | (SPEAK) | (SPEAK) | (SPEAK) | (SPEAK) |
| SF | 16 | (ESC) | | | | POINT | |
| SF | 17 | (SPC) | | | | ZERO | |
| | 1 | | ONE | ONE | ONE | ONE | ONE |
| | 2 | | TWO | TWO | TWO | TWO | TWO |
| | 3 | | THREE | THREE | THREE | THREE | THREE |
| | 4 | | FOUR | FOUR | FOUR | FOUR | FOUR |
| | 5 | | FIVE | FIVE | FIVE | FIVE | FIVE |
| | 6 | | SIX | SIX | SIX | SIX | SIX |
| | 7 | | SEVEN | SEVEN | SEVEN | SEVEN | SEVEN |
| | 8 | | EIGHT | EIGHT | EIGHT | EIGHT | EIGHT |
| | 9 | | NINE | NINE | NINE | NINE | NINE |
| | 0 | | ZERO | ZERO | ZERO | ZERO | ZERO |
| | Q | | I HAVE A QUESTION | PLEASE BE QUIET | QUAKER OATS | ELEVEN | Q |
| | W | | WHERE ARE YOU GOING | WARM | WATER | TWELVE | W |
| | E | | EXCELLENT | TONE | EGGS | THIRTEEN | E |
| | R | | HOW ARE YOU | TO LISTEN TO RADIO | RICE | FOURTEEN | R |
| | T | | I THINK SO | TO BRUSH MY TEETH | TOAST | FIFTEEN | T |
| | Y | | YOU ARE A GOOD FRIEN | TONE | YOGURT | SIXTEEN | Y |
| | U | | I DON'T UNDERSTAND | UPSET | UTENSIL | SEVENTEEN | U |
| | I | | I DON'T KNOW | ILL | ICE CREAM | EIGHTEEN | I |
| | O | | OF COURSE | TO GO OUTSIDE | ORANGE JUICE | NINETEEN | O |
| | P | | PARDON ME | I HAVE A PROBLEM | POTATOES | I NEED MONEY | P |
| | A | | ARTIFICIAL VOICE | TO BE ALONE | A | TWENTY | A |
| | S | | WHAT DID YOU SAY | SAD | SANDWICH | THIRTY | S |
| | D | | HAVE A NICE DAY | TO GET DRESSED | DOUGHNUT | FOURTY | D |
| | F | | FINE | TO WIPE MY FACE | FRUIT | FIFTY | F |
| | G | | GOOD BYE | TO GO SOMEPLACE | GLASS | SIXTY | G |
| | H | | HELLO | HUNGRY | HAMBURGER | SEVENTY | H |
| | J | | JUST A MINUTE | JOYOUS FANFARE | JELLY | EIGHTY | J |
| | K | | OK | TONE | KNIFE | NINETY | K |
| | L | | LOOK AT THIS | I LOVE YOU | LEMONAIDE | EQUALS | L |
| | Z | | ZESTY | ZIPPER | ZUCCHINI | HUNDRED | Z |
| | X | | PLEASE EXPLAIN THAT | EXHAUSTED | THAT WAS EXCLNT MEAL | THOUSAND | X |
| | C | | CONGRATULATIONS | COLD | COOKIES | MILLION | C |

TABLE 1-continued

PHRASE MAP

| | | | | | |
|---|---|---|---|---|---|
| V | VERY GOOD | TO WATCH TV | VEGETABLES | AND | V |
| B | THAT'S BEAUTIFUL | TO GO TO BATHROOM | BREAD | MINUS | B |
| N | WHAT IS YOUR NAME | TONE | NAPKIN | TIMES | N |
| M | NICE TO MEET YOU | PLZ LET ME DO IT SEL | MILK | DIVIDED BY | M |
| INSTRUCTIONS PAGE 6 | DEMONSTRATION PAGE 7 | BLENDING PAGE 8 | ELECTRONIC ORGAN PAGE 9 | COMPOSE SPEECH PAGE A | STORE INFORMATION PAGE 0 |
| PLEASE HELP ME | PLEASE HELP ME | PLEASE HELP ME | PLEASE HELP ME | | PLEASE HELP ME |
| PLEASE HELP ME WITH | PLEASE HELP ME WITH | PLEASE HELP ME WITH | PLEASE HELP ME WITH | | PLEASE HELP ME WITH |
| I WOULD LIKE | I WOULD LIKE | I WOULD LIKE | I WOULD LIKE | | I WOULD LIKE |
| WOULD YOU LIKE | WOULD YOU LIKE | WOULD YOU LIKE | WOULD YOU LIKE | | I WOULD LIKE |
| CHANGE PAGE | CHANGE PAGE | CHANGE PAGE | CHANGE PAGE | | CHANGE PAGE |
| I AM | I AM | I AM | I AM | | I AM |
| ARE YOU | ARE YOU | ARE YOU | ARE YOU | | ARE YOU |
| PLEASE | PLEASE | PLEASE | PLEASE | (APOSTROPHE) | PLEASE |
| THANK YOU | THANK YOU | THANK YOU | THANK YOU | | THANK YOU |
| YOU'RE WELCOME | YOU'RE WELCOME | YOU'RE WELCOME | YOU'RE WELCOME | | YOU'RE WELCOME |
| YES | YES | YES | YES | (SHORT PAUSE/COMMA) | YES |
| NO | NO | NO | NO | (LONG PAUSE/PERIOD) | NO |
| | | /CH/ CHIP | | (ERASE LETTER) | |
| | | /TH/ THINK | | (CLEAR ENTRY) | |
| (SPEAK) | (SPEAK) | (SPEAK) | (SPEAK) | (SPEAK) | (SPEAK) |
| | | /TH/ THIS | | (PHONETICS) | (STORE) |
| | | (STOP) | | (SPACE) | |
| ONE | ONE | LONG /A/ | ONE | | ONE |
| TWO | TWO | LONG /E/ | TWO | | TWO |
| THREE | THREE | LONG /I/ | THREE | | THREE |
| FOUR | FOUR | LONG /O/ | FOUR | | FOUR |
| FIVE | FIVE | LONG /U/ | FIVE | | FIVE |
| SIX | SIX | /OO/ MOVE | SIX | | SIX |
| SEVEN | SEVEN | /OO/ LOOK | SEVEN | | SEVEN |
| EIGHT | EIGHT | /OU,OW/ COk | EIGHT | | EIGHT |
| NINE | NINE | /OI,OY/ BOY | NINE | | NINE |
| ZERO | ZERO | /SH/ SHIP | ZERO | | ZERO |
| TO ERASE SPEAK KEY | FOREIGN LANGUAGE? | /KW/ | | | |
| OPERATE BY BATTERY/P | TELEPHONE SAMPLE | /W/ | C# | | |
| PAGE 4 KEY LABELS | DINNER TIME | SHORT /E/ | D# | | |
| PAGE A ERASE LETTER | DEUTSCH POLISH | /R/ | | | |
| PAGE 0 LETTER KEYS | HOW MUCH THIS COST | /T/ | F# | | |
| CAR LIGHTER POWER | HELP EMERG | /Y/ | G# | | |
| STORE SPEAK KEY ENTR | TELEPHONE CONVERSATI | SHORT /U/ | A# | | |
| PAGE 9 IS A MUSIC SY | CAN YOU SPELL WORDS | SHORT /I/ | | | |
| LED DECIMAL = INFO | OTHER MUSIC? | SHORT /O/ | C# | | |
| SPEAK KEY TO SPEAK | ORGAN PAGE 9 | /P/ | D# | | |
| B-Z TEACH | HELLO | SHORT /A/ | C | | |
| REFINE PRONUNCIATION | SAY 4 SHOPPING | /S/ | D | | |
| PAGES 1-3 LETTER KEY | GIVE ME SITUATIONS | /D/ | E | | |
| PAGE 5 KEYS SPEAK | MEAT AND POTATOES | /F/ | F | | |
| PAGES 6/7 = INSTRUCT | LEISURE TIME | /G/ | G | | |
| PAGE 8 = ENG. SOUNDS | WATCH TV? | /H/ | A | | |
| BLUE KEY USE | S M I L E | /J/ | B | | |
| SHEA PRODUCTS PHRASE | CAN YOU SING? | /K/ | C | | |

TABLE 1-continued

| PHRASE MAP | | | |
|---|---|---|---|
| PAGE A = CREATE OWN | DO RE MI FA SO LA TI | /L/ | D |
| BATTERY INDICATOR | PLEASE SEND DOCTOR | /Z/ | |
| OVERNIGHT CHARGING | ORDER FROM CATALOG | /KS/ | |
| CHANGE PAGE KEY | SHOW ME SAMPLES | /K/ | |
| OPER | | | |
| PAGE 0 MEMORY | CONV PROGRAMMED | /V/ | |
| S.F. ORGANIZATION | I'M FINE | /B/ | OCTAVE 1 |
| PAGE A = TYPEWRITER | HAPPY BIRTHDAY | /N/ | OCTAVE 2 |
| PAGE A SPECIAL EFFEC | SOMETHING SERIOUS | /M/ | OCTAVE 3 |

Figure 7:
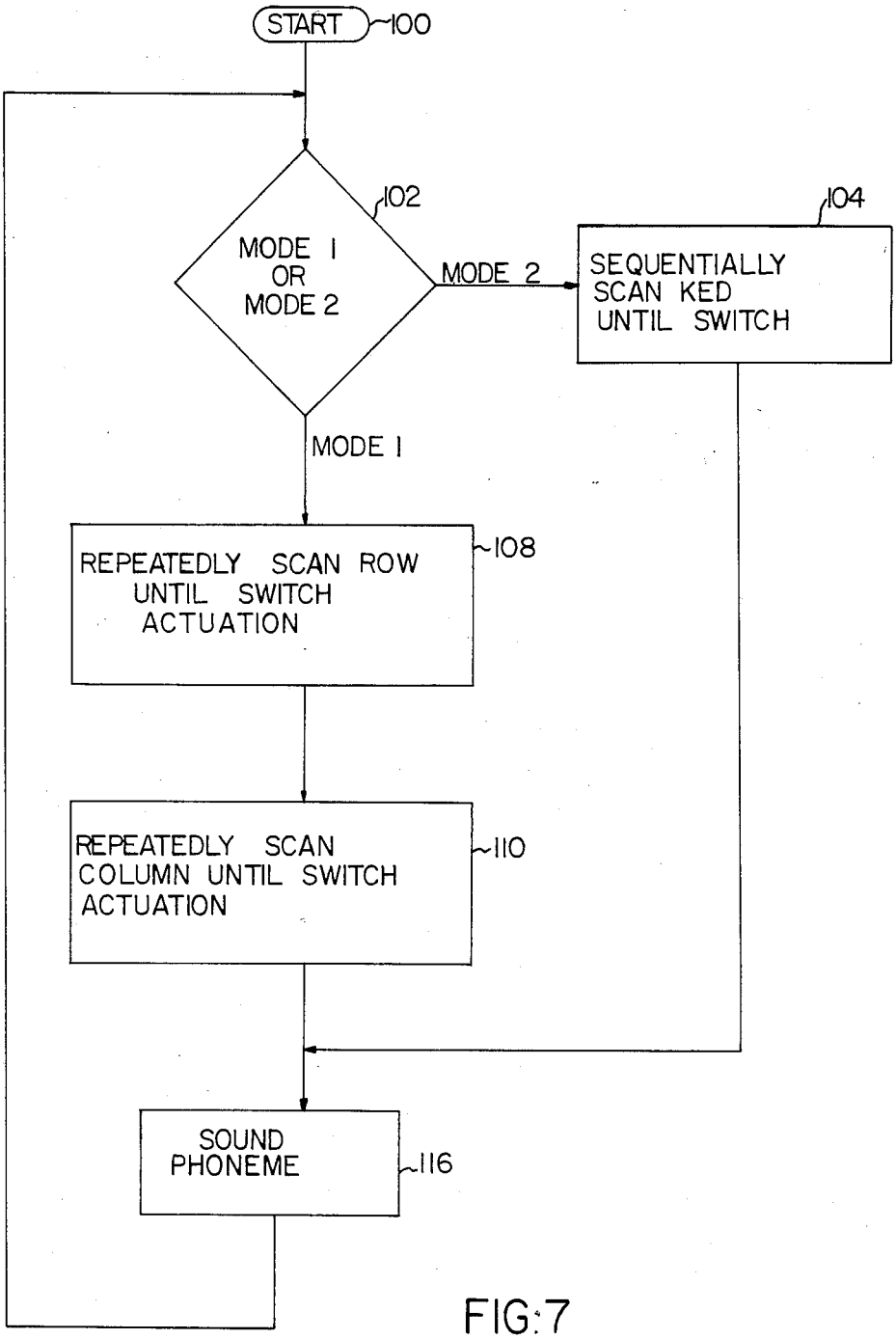
FIG. 7 is a flow chart illustrating the operation of the preferred embodiment of the present invention.

With reference now to FIG. 7, a flow chart illustrating the operation of the device of the present invention is thereshown. The system is first initialized at step 100 which then proceeds to step 102 which determines whether the mode 1 or mode 2 scanning operation of the keyboard is in effect. In the event that the second mode or mode 2 operation of the keyboard is in effect, step 102 branches to step 104 in which the keyboard is sequentially scanned until the switch means is actuated. When this occurs, step 104 branches to step 106 which sounds the phoneme. After step 106, the above process is repeated.

Conversely, in the event that mode 1 operation has been selected step 102 branches to step 108 in which a single row of the keyboard is sequentially scanned until the switch means is acuated. The actual scanning of the keyboard, of course, is detected by the user due to the illumination provided by the LED associated with each key.

After actuation of the switch means, step 108 branches to step 110 in which the column is repeatedly scanned until the user again actuates the switch means. When this occurs, the data identifier or key has been selected so that step 110 branches to step 106 and sounds the phoneme.

In view of the foregoing, it can be seen that a vocalizing device of the present invention provides a useful vocalizing device for individuals regardless of the particular motor skills or reading ability. Moroever, the vocalizing device permits the operator to express himself more completely and fully in view of the fact that a wide variety of inflection of voices can be applied to the spoken message and that personal messages can be stored for later use. In addition, even individuals having limited reading ability for engaged in learning since words can actually be sounded out at the pace determined by the operator.

Having thus described the present invention, many modifications thereto will become apparent to those skilled in the art to which it pertains without departing from the scope and spirit of the present invention as defined in the appended claims.

What is claimed is:

1. A portable vocalizing device comprising:

microprocessor means for storing and accessing data including programmed means for controlling said microprocessor, input means for manually selecting said data, synthesizer means for synthetically sounding the phonemes and phoneme combinations represented by said selected data, display means for visibly indicating the alphabetic character of the phoneme and phoneme combinations represented by said selected data, an electrical power supply circuit means for selectively connecting an electrical power source to said microprocessor means and said synthesizer means, wherein said input means comprises a keyboard having a plurality of data identifiers and a switch means, each of said data identifiers having an illuminator, means for selectively activating said illuminators in either of a first or a second mode, wherein in said first mode said illuminators are repeatedly and sequentially illuminated in a predetermined row until a first activation of said switch means whereupon said illuminators are repeatedly and sequentially illuminated in a column selected upon said first activation, said repeated and sequential illumination in said column continuing until a second activation of said switch means whereupon the illuminated data identifier corresponds to the selected data, and wherein in said second mode said illuminators are repeatedly and sequentially illuminated by row and column until activation of said switch means whereupon the illuminated data identifier corresponds to the selected data.

2. The invention as defined in claim 1 wherein each illuminator comprises an LED.

3. The invention as defined in claim 1 wherein said switch means comprises at least one normally open, single pole switch, at least one multiple terminal console having at least three and not more than five switches and at least one light sensitive switch.

4. The invention as defined in claim 1 wherein said switch means comprises a five position switch having joystick control with switch means for engaging at least four contact terminals.

5. The invention as defined in claim 1 wherein said switch means comprises a light sensitive detector having a body and wherein said scanning means comprises means for sensing a light positioned in registration with an end of said body.

6. The invention as defined in claim 1 wherein said programmed means comprises means for indefinitely sustaining phonemes.

7. The invention as defined in claim 1 wherein said programmed means comprises means for generating a plurality of pitches for phonemes synthetically vocalized, and further comprising means for selecting one of said plurality of tones.

8. The invention as defined in claim 7 wherein said programmed means comprises means for generating a plurality of voice levels for each phoneme synthetically vocalized, and means for selecting one of said plurality of voice levels.

9. The invention as defined in claim 8 wherein said programmed means further comprises means for generating a plurality of inflections for each phoneme voice level.

10. The invention as defined in claim 1 comprising programmable memory means for storing data, and means for maintaining data in said programmable memory means after electrical power has been removed from said electrical power input circuit, said means including a battery and second switching means for maintaining power at said programmable member by coupling said battery to said programmable memory means when said first switching means disconnects said power supply circuit from said circuit components.

11. The invention as defined in claim 1 wherein said keyboard face comprises a first set of data identifiers positioned to correspond with a typewriter keyboard arrangement and a second set of data indentifiers peripherally positioned around said first set.

12. The invention as defined in claim 13 wherein said programmed means comprises means for assigning a plurality of phonemes and phoneme combinations to each data identifier of said first set and means for selecting a predetermined one of said plurality of phonemes and phoneme combinations for each data identifier of said first set, and means for assigning at least one data entry to each data identifier of said second set.

* * * * *

UNITED STATES PATENT AND TRADEMARK OFFICE

CERTIFICATE OF CORRECTION

PATENT NO. : 4,788,649

DATED : November 29, 1988

INVENTOR(S) : J. William Shea, James P. Shea and Patrick Lademan

It is certified that error appears in the above-identified patent and that said Letters Patent is hereby corrected as shown below:

Col. 2, line 38, delete "tthe" and insert --the--;

Col. 5, line 37, delete "of" second occurrence;

Col. 8, line 33, delete "interuption" and insert --interruption--;

Cols. 13-14 under heading Page 4, delete "zero" and insert --ten--;

Col. 19, line 16, delete "acuated" and insert --actuated--;

line 34, delete "engaged" and insert --engaging--;

Col. 20, line 60, delete "13" and insert --11--.

Signed and Sealed this

Second Day of January, 1990

*Attest:*

JEFFREY M. SAMUELS

*Attesting Officer*

*Acting Commissioner of Patents and Trademarks*